US005986609A

United States Patent [19]

Spall

[11] Patent Number: 5,986,609

[45] Date of Patent: Nov. 16, 1999

[54] MULTIPLE FREQUENCY BAND ANTENNA

[75] Inventor: John M. Spall, Cary, N.C.

[73] Assignee: Ericsson Inc., Research Triangle Park, N.C.

[21] Appl. No.: 09/089,433

[22] Filed: Jun. 3, 1998

[51] Int. Cl.[6] ..... H01Q 1/24

[52] U.S. Cl. ..... 343/702; 343/700 MS; 343/795

[58] Field of Search ..... 343/702, 700 MS, 343/792.5, 895, 795, 796; H01Q 1/24

[56] References Cited

U.S. PATENT DOCUMENTS

| | | | |
|---|---|---|---|
| 2,990,547 | 6/1961 | McDougal | 343/792.5 |
| 4,658,262 | 4/1987 | DuHamel | 343/792.5 |
| 4,860,019 | 8/1989 | Jiang et al. | 343/795 |
| 5,313,216 | 5/1994 | Wang et al. | 343/700 MS |
| 5,561,437 | 10/1996 | Phillips et al. | 343/702 |
| 5,563,616 | 10/1996 | Dempsey et al. | 343/700 MS |

*Primary Examiner*—Don Wong
*Assistant Examiner*—Hoang Nguyen
*Attorney, Agent, or Firm*—Myers Bigel Sibley & Sajovec, P.A.

[57] ABSTRACT

Antennas configured to be enclosed within a flip cover of a radiotelephone and to resonate in three frequency bands include a dielectric substrate having opposite first and second faces, and opposite first and second ends. A first radiating element is disposed on the first face adjacent the first end, and a second radiating element is disposed on the dielectric substrate second face adjacent the second end. Each radiating element tapers from a respective end of the substrate to a medial portion of a respective face. Each radiating element also includes a respective meandering electrically conductive path.

35 Claims, 7 Drawing Sheets

MULTIPLE FREQUENCY BAND ANTENNA

FIELD OF THE INVENTION

The present invention relates generally to antennas, and more particularly to antennas used within communication devices.

BACKGROUND OF THE INVENTION

Antennas for personal communication devices, such as radiotelephones, may not function adequately when in close proximity to a user during operation, or when a user is moving during operation of a device. Close proximity to objects or movement of a user during operation of a radiotelephone may result in degraded signal quality or fluctuations in signal strength, known as multipath fading. Diversity antennas have been designed to work in conjunction with a radiotelephone's primary antenna to improve signal reception and overcome multipath fading.

Many of the popular hand-held radiotelephones are undergoing miniaturization. Indeed, many of the contemporary models are only 11–12 centimeters in length. Unfortunately, as radiotelephones decrease in size, the amount of internal space therewithin may be reduced correspondingly. A reduced amount of internal space may make it difficult for existing types of diversity antennas to achieve the bandwidth and gain requirements necessary for radiotelephone operation because their size may be correspondingly reduced.

Furthermore, it may be desirable for a radiotelephone antenna to be able to resonate over multiple frequency bands. For example, the Japanese Personal Digital Cellular (PDC) system utilizes two "receive" frequency bands and two "transmit" frequency bands. Accordingly, both primary and diversity antennas within a radiotelephone used in the Japanese PDC system should preferably be able to resonate in each of the two receive frequency bands. Unfortunately, the ability to provide diversity antennas with adequate gain over multiple frequency bands may be presently limited because of size limitations imposed by radiotelephone miniaturization.

The addition of Global Positioning System (GPS) features to radiotelephones may require yet another diversity and primary antenna resonance. Unfortunately, diversity antennas are often too small and have inadequate gain and bandwidth for satisfactory operation in GPS frequency bands. Furthermore, conventional dual-band radiotelephone primary antennas are generally unsatisfactory for operation in GPS frequency bands.

SUMMARY OF THE INVENTION

It is, therefore, an object of the present invention to provide antennas that may resonate over multiple frequency bands, including GPS frequency bands, with sufficient gain for use within personal communication devices such as radiotelephones.

It is also an object of the present invention to provide reduced size antennas that may resonate over multiple frequency bands, including GPS frequency bands, with sufficient gain and that can be installed within the small internal space of miniature radiotelephones.

These and other objects of the present invention are provided by small, planar antennas configured to be enclosed within communications devices, such as radiotelephones, and to resonate in three frequency bands. Antennas according to the present invention may be used as either diversity or primary radiotelephone antennas.

According to one aspect of the present invention, a dielectric substrate includes opposite first and second faces, and opposite first and second ends. A first radiating element is disposed on the first face adjacent the first end, and a second radiating element is disposed on the dielectric substrate second face adjacent the second end. The first and second radiating elements jointly resonate within three frequency bands.

Each radiating element tapers from a respective end of the substrate to a medial portion of a respective face. Each radiating element also includes a respective meandering electrically conductive path. The radiating elements may have various configurations and shapes and may include meandering electrically conductive paths of different electrical lengths. Furthermore, electrical traces may be utilized to add electrical length to each radiating element.

According to another aspect of the present invention, a small antenna configured to resonate in three frequency bands may include a dielectric substrate and a radiating element disposed on a face of the dielectric substrate adjacent an end thereof. The radiating element tapers from an end of the dielectric substrate to a medial portion of the face and includes a meandering electrically conductive path.

According to another aspect of the present invention, an antenna assembly configured to resonate in three frequency bands is provided. A dielectric substrate includes opposite first and second faces, and opposite first and second ends. A first radiating element is disposed on the first face adjacent the first end, and the second radiating element is disposed on the dielectric substrate second face adjacent the second end. Each radiating element tapers from a respective end of the substrate to a medial portion of a respective face and includes a respective meandering electrically conductive path. An aperture is formed through dielectric substrate adjacent the medial portions of the first and second faces. A first conductor of an antenna feed is electrically connected to the first radiating element via the aperture within the dielectric substrate. A second conductor of the antenna feed is electrically connected to the second radiating element.

According to another aspect of the present invention, a radiotelephone includes a housing, a flip cover hinged thereto, and an antenna assembly configured to resonate within three frequency bands disposed within the flip cover. A dielectric substrate includes opposite first and second faces, and opposite first and second ends. A first radiating element is disposed on the first face adjacent the first end, and a second radiating element is disposed on the dielectric substrate second face adjacent the second end. The first and second radiating elements jointly resonate within three frequency bands.

According to another aspect of the present invention, a radiotelephone includes an antenna assembly configured to resonate within three frequency bands disposed therewithin. An antenna includes a dielectric substrate and a radiating element disposed on a face of the dielectric substrate adjacent an end thereof. The radiating element tapers from an end of the dielectric substrate to a medial portion of the face.

Antennas according to the present invention, whether used as diversity or primary antennas, may be advantageous because their thin, planar configurations may allow them to fit within a flip cover of a radiotelephone, while providing adequate gain and bandwidth over three frequency bands. The triple frequency band functionality of antennas according to the present invention may be particularly advantageous when a radiotelephone incorporates GPS features with other frequency band operations. An antenna incorporating aspects of the present invention may be used within various mobile telephone frequency bands including, but not limited to: Advanced Mobile Phone System (AMPS), Digital Advanced Mobile Phone System (DAMPS), Global System for Global Communications (GSM), Personal Digital Cellular (PDC), Digital Communication System (DCS), Personal Communication System (PCS), as well as GPS.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
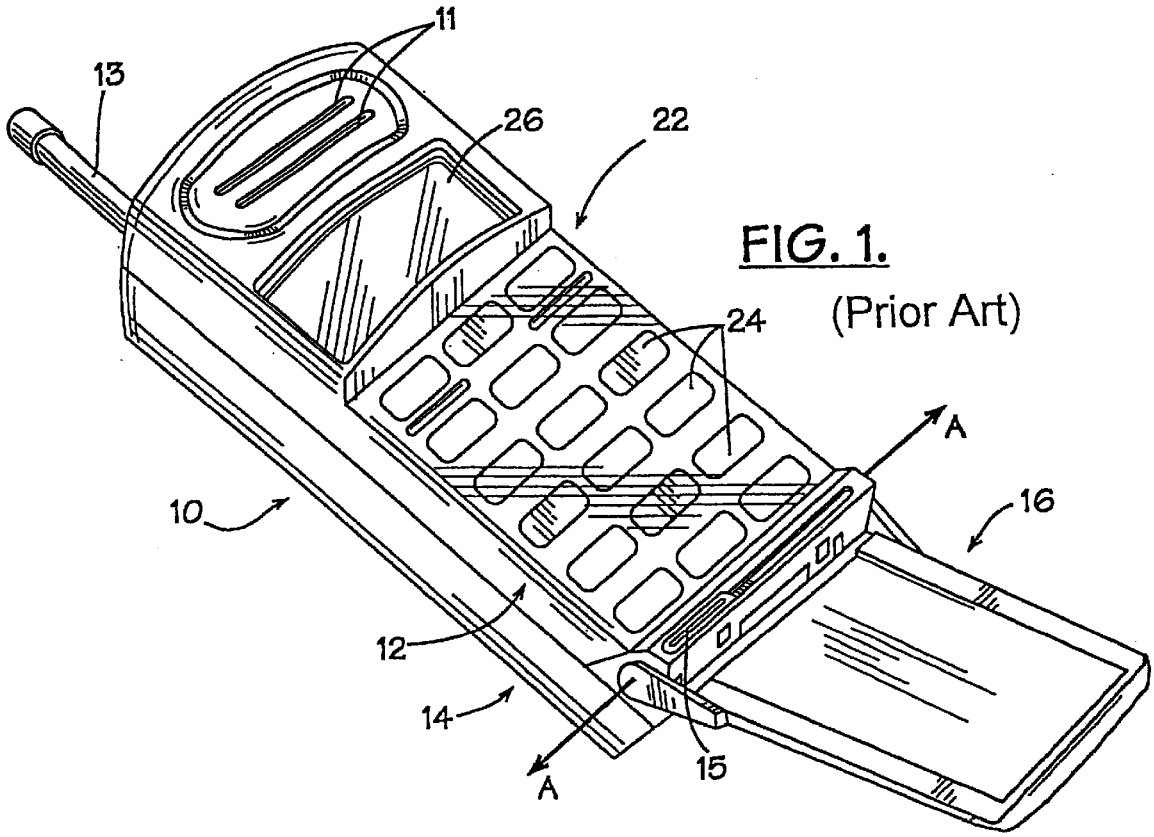
FIG. 1. (Prior Art)
FIG. 1 illustrates an exemplary flip cover for a radiotelephone within which an antenna according to the present invention may be incorporated.

Referring now to FIG. 1, a "flip phone" style radiotelephone 10 is illustrated. The illustrated radiotelephone 10 includes a top handset housing 12 and a bottom handset housing 14 connected thereto to form a cavity therein. Top and bottom handset housings 12 and 14 house a keypad 22 including a plurality of keys 24, a display 26, and electronic components (not shown) that enable the radiotelephone 10 to transmit and receive telecommunications signals. A flip cover 16 is hinged to one end of the top housing 12, as illustrated.

In operation, the flip cover 16 may be pivoted by a user about axis A between closed and open positions. When in a closed position, the flip cover 16 may provide protection to the keypad 22 mounted within the top handset housing 12 from unintentional activation or exposure to the elements. When in an open position, the flip cover 16 may provide a convenient extension to the radiotelephone 10 and, when fitted with a microphone, may be favorably positioned to receive audio input from a user. In addition to these tangible benefits, there may also be unqualified consumer appeal for flip covers. According to the present invention, diversity and/or primary antennas may be included within the flip cover 16.

Figure 2:
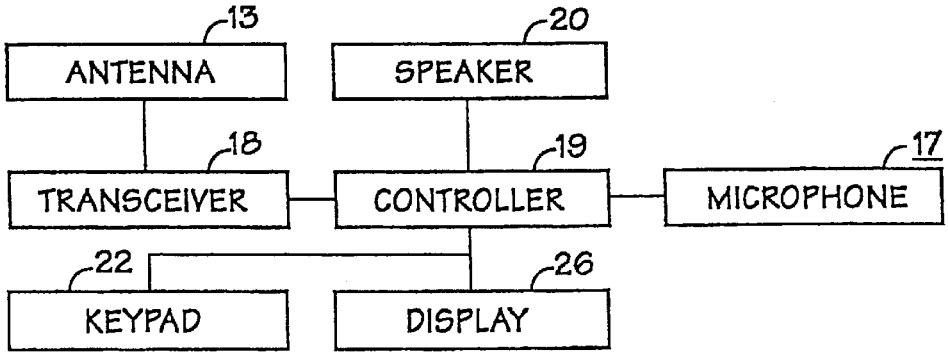
FIG. 2. (Prior Art)
FIG. 2 is a schematic illustration of a conventional arrangement of electronic components for enabling a radiotelephone to transmit and receive telecommunications signals.

A conventional arrangement of electronic components that enable a radiotelephone to transmit and receive telecommunications signals is shown schematically in FIG. 2, and is understood by those skilled in the art of radiotelephone communications. A primary antenna 13 (also visible in FIG. 1) for receiving and transmitting telecommunication signals is electrically connected to a radio-frequency transceiver 18 that is further electrically connected to a controller 19, such as a microprocessor. The controller 19 is electrically connected to a speaker 20 that transmits a remote signal from the controller 19 to a user of a radiotelephone. The controller 19 is also electrically connected to a microphone 17 that receives a voice signal from a user and transmits the voice signal through the controller 19 and transceiver 18 to a remote device. The controller 19 is electrically connected to a keypad 22 and display 26 that facilitate radiotelephone operation.

Referring back to FIG. 1, slots 11 may be provided at one end of the radiotelephone 10 for allowing a user to hear audio communications via a speaker enclosed within the top and bottom handset housings 12, 14. One or more slots 15 may also be provided at an opposite end of the radiotelephone 10 for allowing a user to speak into a microphone enclosed within the top and bottom handset housings 12, 14. When open, the flip cover 16 may direct sound from a user towards the microphone slots 15. When the flip cover 16 is closed, sound from a user may pass through a slot (not shown) between the flip cover and the top handset housing 12, as is known to those skilled in the art. Accordingly, a user may operate a radiotelephone with a flip cover in either an open or closed position.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain. Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna should be matched to the impedance of a transmission line or feeder.

Conventional radiotelephones employ a primary antenna which is electrically connected to a transceiver operably associated with a signal processing circuit positioned on an internally disposed printed circuit board. In order to maximize power transfer between a primary antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the circuit feed.

As is well known to those skilled in the art of radiotelephones, a diversity antenna may be utilized in conjunction with a primary antenna within a radiotelephone to prevent calls from being dropped due to fluctuations in signal strength. Signal strength may vary as a result of a user moving between cells in a cellular telephone network, a user walking between buildings, interference from stationary objects, and the like. Diversity antennas are designed to pick up signals that a main antenna is unable to pick up through spatial, pattern, and bandwidth or gain diversity. Diversity antennas may also be utilized to offset Rayleigh fading, which may include sudden deep fades or losses of signal strength due to multipath phase cancellation.

Referring now to FIGS. 3A–3D a multiple frequency band ½ wave antenna 30 in accordance with a preferred embodiment of the present invention is illustrated. The illustrated antenna 30 may be utilized as a diversity antenna or as a primary antenna for a communications device, such as a radiotelephone. Preferably, the illustrated antenna 30 has a dipole structure with a generally rectangular configuration. Preferably, the antenna 30 has a thickness T, a width W, and a length L such that the antenna 30 can be housed within the flip cover of a communications device, such as the flip cover 16 of the radiotelephone 10 of FIG. 1. However, antennas incorporating aspects of the present invention may have various configurations and shapes, and are not limited to the illustrated rectangular configurations.

Figure 3A:
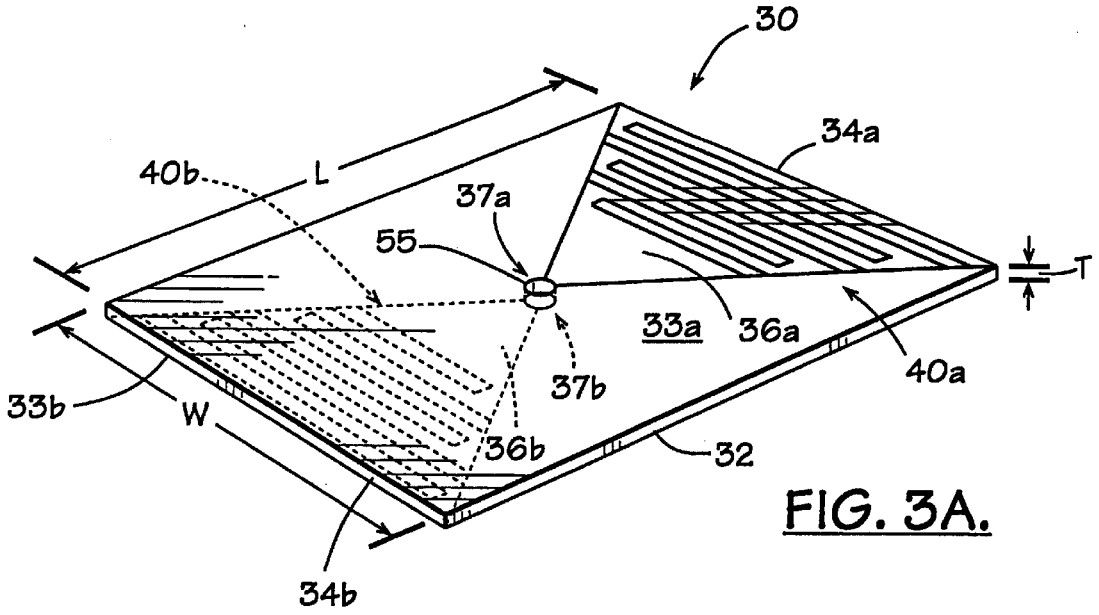
FIGS. 3A–3D illustrate aspects of a multiple frequency band ½ wave antenna according to an embodiment of the present invention.

The illustrated antenna 30 of FIG. 3A includes a dielectric substrate 32, such as a fiberglass circuit board, having first and second opposite faces 33*a* and 33*b*, and opposite first and second ends 34*a* and 34*b*. The dielectric substrate 32 may be formed from an FR4 board, which is well known to those having skill in the art of communications devices. However, various dielectric materials may be utilized for the dielectric substrate 32 without limitation. Preferably, the dielectric substrate 32 has a dielectric constant between about 4.4 and about 4.8 for the illustrated embodiment. However, it is to be understood that dielectric substrates having different dielectric constants may be utilized without departing from the spirit and intent of the present invention.

Dimensions of the illustrated dielectric substrate 32 may vary depending on the space limitations of a flip cover of a radiotelephone or other communications device within which the antenna 30 is to be incorporated. Typically, the dielectric substrate 32 will have a thickness T of between 0.7 and 1.0 millimeters (mm); a width W of between 35 and 45 mm; and a length L of between 45 and 55 mm. Exemplary dimensions for a dielectric substrate configured to be housed within a flip cover of a radiotelephone are about 50 mm in length L, 40 mm in width W, and 0.787 mm in thickness T. However, antennas according to embodiments of the present invention may have various dimensions without limitation.

Figure 3B:
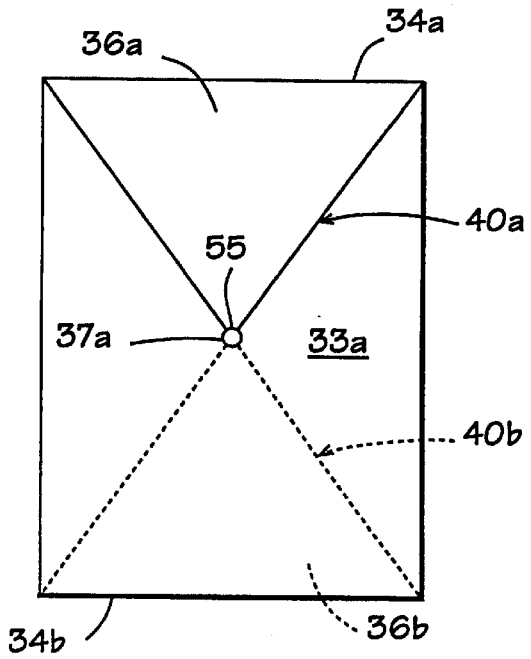
Figure 3C:
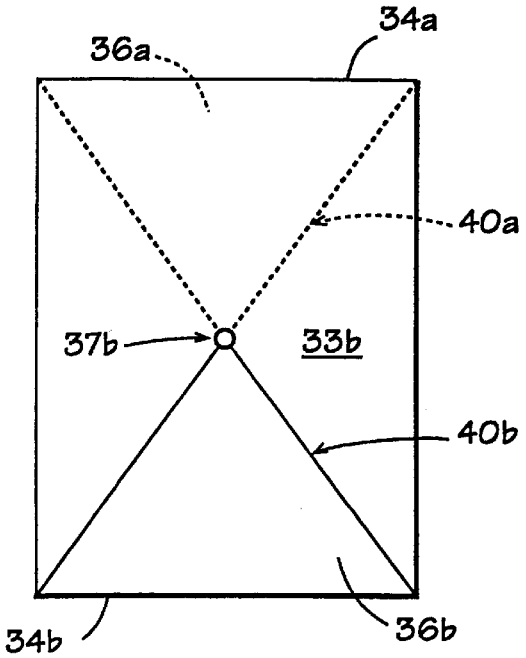

Still referring to FIG. 3A, a layer of "triangle-shaped" copper or other conductive material is secured to the first and second substrate faces 33*a* and 33*b*, at opposite ends 34*a* and 34*b*, as illustrated, and is indicated as 36*a* and 36*b*, respectively. FIG. 3B illustrates the conductive layer 36*a* on the dielectric substrate first face 33*a*. FIG. 3C illustrates the conductive layer 36*b* on the dielectric substrate first face 33*b*.

Each respective layer of conductive material 36*a*, 36*b* is positioned on a respective face 33*a*, 33*b* such that the "base" of each triangle is adjacent a respective substrate end 34*a*, 34*b*, as illustrated. Each conductive layer tapers from a respective end 34*a*, 34*b* to a respective medial portion 37*a*, 37*b* on each face 33*a*, 33*b*. The illustrated configuration is referred to as a "bow tie" configuration because the layers of conductive material 36*a*, 36*b* on opposite sides 33*a*, 33*b* of the substrate 32 gives the appearance of a bow tie when the dielectric substrate 32 is held up to a light.

It is to be understood that the layers of conductive material 36*a*, 36*b* may have other configurations and are not limited to the illustrated triangle-shaped configurations. For example, the layers of conductive material 36*a*, 36*b* may taper from a respective substrate end 34*a*, 34*b* in a generally rounded configuration. Furthermore, the layer of conductive material 36*a* on the first face 33*a* may be larger or smaller than the layer of conductive material 36*b* on the second face 33*b*.

A preferred conductive material for forming the illustrated layers of conductive material 36*a*, 36*b* is copper tape. Copper tape allows portions thereof to be removed easily during tuning of the antenna. Typically, the thickness of the layers of conductive material 36*a*, 36*b* on each respective substrate surface 33*a*, 33*b* is between about 0.5 ounces (oz.) and about 1.0 oz. copper.

As will be described below, the first and second dielectric substrate faces 33*a*, 33*b* and the respective layers of conductive material 36*a*, 36*b* thereon function as respective first and second radiating elements, indicated as 40*a* and 40*b*. As will be described below, the radiating elements 40*a*, 40*b* allow the antenna 30 to be tuned so as to resonate within at least three, or more, frequency bands.

Figure 3D:
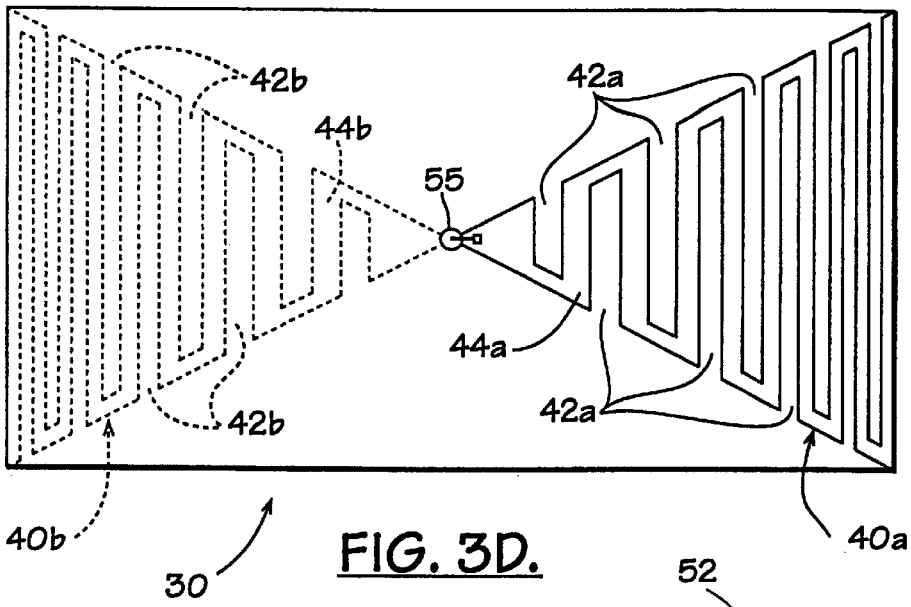

Referring now to FIG. 3D, an enlarged plan view of the antenna 30 of FIG. 3A is illustrated. As illustrated, portions or slots 42*a*, 42*b* of each conductive layer 36*a*, 36*b* respectively, have been removed to create meandering electrically conductive patterns for radiating RF energy, indicated as 44*a* and 44*b*, respectively. The length of each meandering electrically conductive pattern 44*a*, 44*b* is a tuning parameter, as is known to those skilled in the art. The first and second radiating elements 40*a*, 40*b* allow the antenna 30 to resonate within three different frequency bands.

The slots 42*a*, 42*b* in the radiating elements 40*a*, 40*b* behave differently at different frequencies. At lower frequencies, such as 800 MHz bands, the electrical length of the radiating elements 40*a*, 40*b* is typically the longest. At mid-range and high frequencies, such as 1500 and 1900 MHz bands, the electrical length of the radiating elements 40*a*, 40*b* becomes shorter. At higher frequencies, the wavelength becomes smaller and this reduces the effect of the slots 42*a*, 42*b* because the energy can jump over the slots.

Figure 4A:
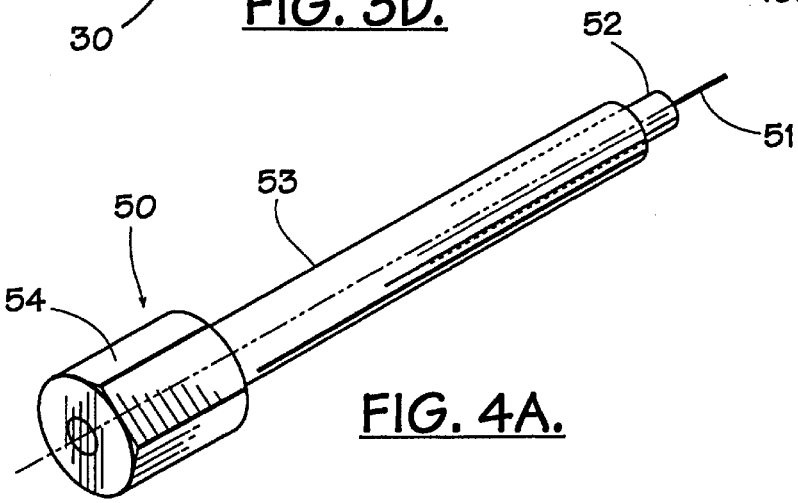
FIG. 4A illustrates an exemplary coaxial antenna feed for use with an antenna according to the present invention.

Referring now to FIG. 4A, an exemplary coaxial antenna feed 50 for use with an antenna according to the present invention, is illustrated. The illustrated coaxial antenna feed 50 is a coaxial cable having a center conductor 51, an internal dielectric 52 and an outer conductor 53, and having an SMA-MALE connector 54.

Figure 4B:
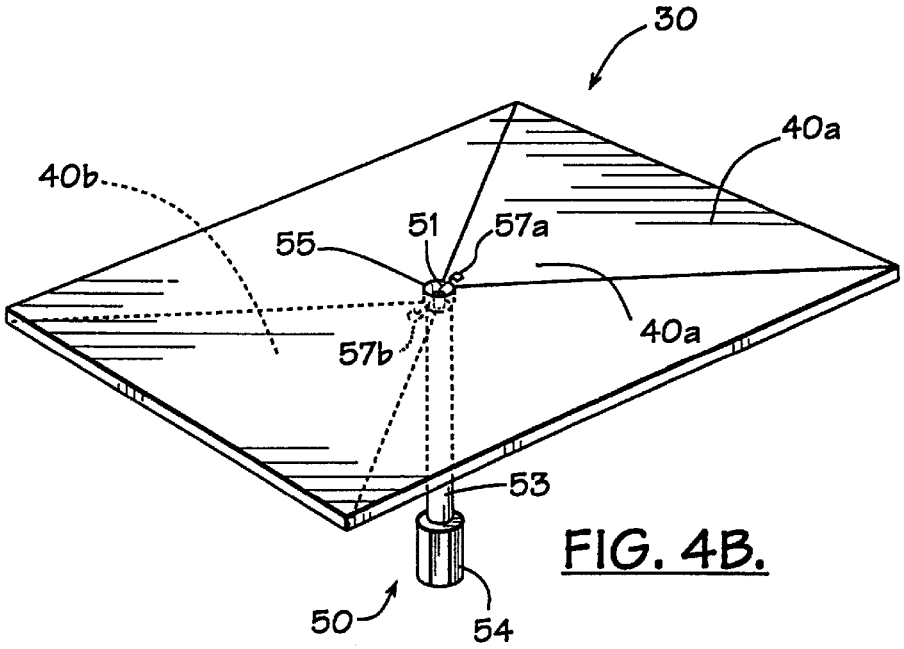
FIG. 4B illustrates the coaxial antenna feed of FIG. 4A electrically connected to the antenna of FIGS. 3A–3D.

The coaxial antenna feed 50 of FIG. 4A is electrically connected to the antenna 30 of FIGS. 3A–3D as illustrated in FIG. 4B. The meandering electrically conductive patterns 44*a*, 44*b* of respective radiating elements 40*a*, 40*b* are not shown in FIG. 4B for clarity. The center conductor 51 is inserted through an aperture 55 in a medial portion of the dielectric substrate, as illustrated. The center conductor 51 is electrically connected to the first radiating element 40*a* (indicated by 57*a*). The outer conductor 53 is electrically connected to the second radiating element 40*b* (indicated by 57*b*). As would be understood by those skilled in the art of antennas, the center conductor 51 and outer conductor 53 may be electrically connected to the respective first and second radiating elements 40*a*, 40*b* using solder, conductive adhesives, and the like. As is understood by those skilled in the art of radiotelephones, the antenna feed 50 provides a pathway for RF input and output to and from a radiotelephone transceiver.

Tuning parameters for an antenna 30 according to the present invention include, but are not limited to: the length L of the antenna 30; the width W of the antenna 30; the thickness T of the dielectric substrate 32 (FIG. 3A); the dielectric constant of the substrate; the length of the meandering electrically conductive patterns 44*a*, 44*b* (FIG. 3D) of each respective radiating elements 40*a*, 40*b*; the location of the aperture 55 (FIG. 4B) in the dielectric substrate 32; and the size of each of the respective radiating elements 40*a*, 40*b*. The dielectric substrate 32 and length of the meandering electrically conductive patterns 44*a*, 44*b* define "electrical length" necessary to radiate a resonance structure.

Figure 5:
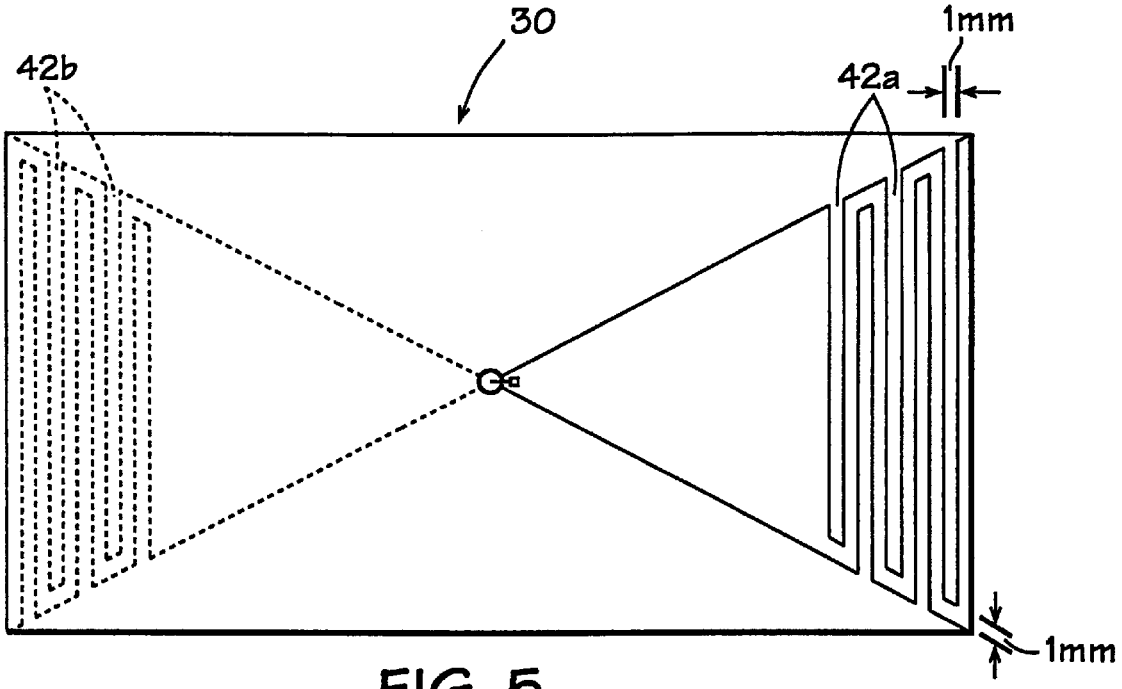
FIG. 5 illustrates an antenna having five slots of approximately 1 millimeter width in each respective radiating element.

FIG. 5 illustrates an antenna 30 according to the present invention having five slots 42*a*, 42*b* of approximately 1 mm width in each respective radiating element 40*a*, 40*b*. The illustrated antenna 30 of FIG. 5 is capable of resonating in three different frequency bands. The illustrated antenna 30 may be tuned so as to change the frequency bands within which the antenna 30 resonates by increasing or decreasing the width and/or length of the respective slots 42*a*, 42*b* and by increasing or decreasing the number of slots 42*a*, 42*b*.

Various alternative embodiments of antennas incorporating aspects of the present invention are illustrated in FIGS. 6A–6E. In each of the illustrated embodiments, the dielectric substrate 32 has the same general configuration and dimensions as the dielectric substrate of FIGS. 3A–3D. However, variations from the antenna of FIGS. 3A–3D include different sizes and shapes of radiating elements 40*a*, 40*b*, and the addition of internal electrical traces for adding electrical length to a radiating element. It is understood that each of the illustrated antennas of FIGS. 6A–6E may serve as diversity or primary antennas within communications devices such as radiotelephones.

The meandering electrically conductive patterns of each respective radiating element 40*a*, 40*b* are not shown in FIGS. 6A, 6B, 6D, or 6E for clarity. However, it is to be understood that each respective radiating element 40*a*, 40*b* of FIGS. 6A, 6B, 6D, and 6E contains a respective meandering electrically conductive pattern as described above. In addition, for FIGS. 6A, 6B, 6C, and 6D it is understood that a first conductor of an antenna feed is electrically connected to a first radiating element 40*a* and a second conductor of an antenna feed is electrically connected to a second radiating element 40*b*, as described above.

Figure 6A:
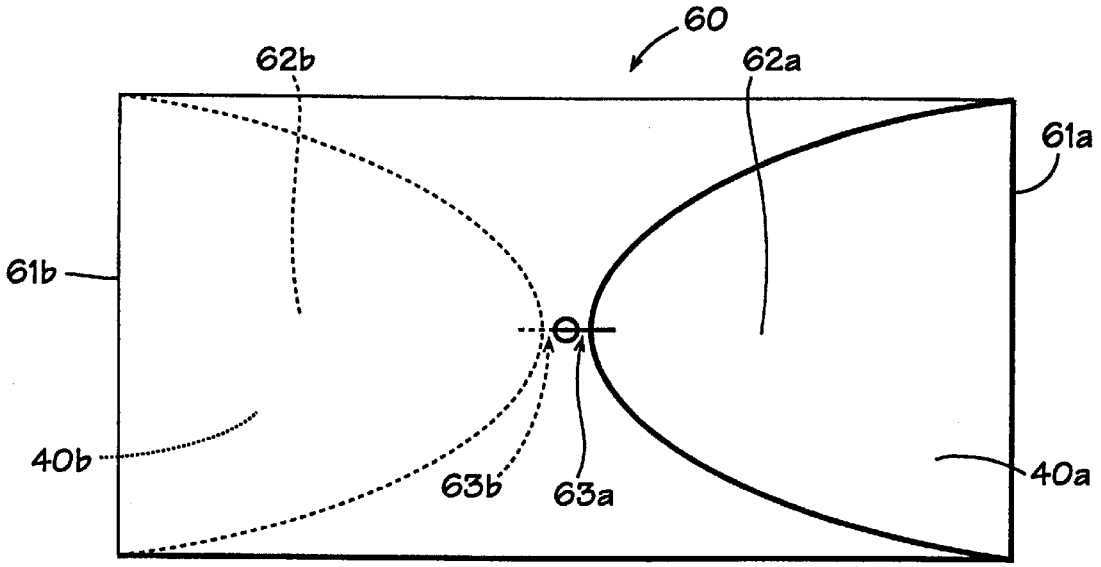
FIGS. 6A–6E illustrate various alternative embodiments of antennas incorporating aspects of the present invention.

Referring now to FIG. 6A, the first and second radiating elements 40*a*, 40*b* of the illustrated antenna 60 have generally rounded tapered portions 62*a* and 62*b*, respectively. The first and second radiating elements 40*a*, 40*b* taper from respective ends 61*a* and 61*b* of the antenna 60 to respective medial portions 63*a*, 63*b* of the antenna 60, as illustrated.

Figure 6B:
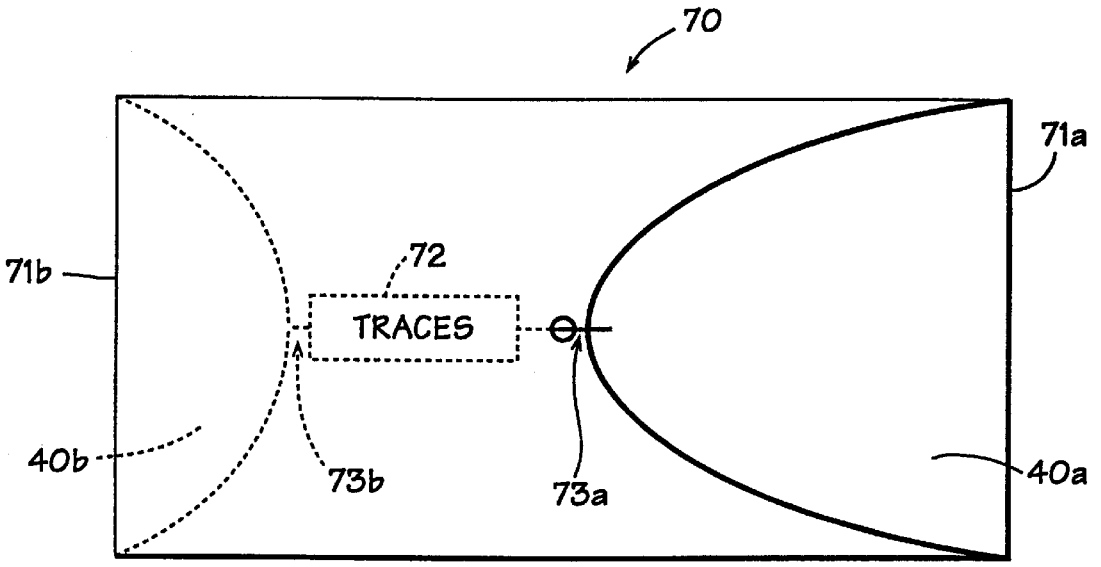

In FIG. 6B, the first and second radiating elements 40*a*, 40*b* of the illustrated antenna 70 have different shapes and configurations. The first radiating element 40*a* is larger than the second radiating element 40*b*. The first and second radiating elements 40*a*, 40*b* taper from respective ends 71*a* and 71*b* of the antenna 70 to respective medial portions 73*a* and 73*b* of the antenna 70, as illustrated. Electrical traces 72 are utilized to increase the electrical length of the second radiating element 40*b*. The electrical traces 72 are positioned between the respective medial portions 73*a* and 73*b* of the antenna 70, as illustrated.

Figure 6C:
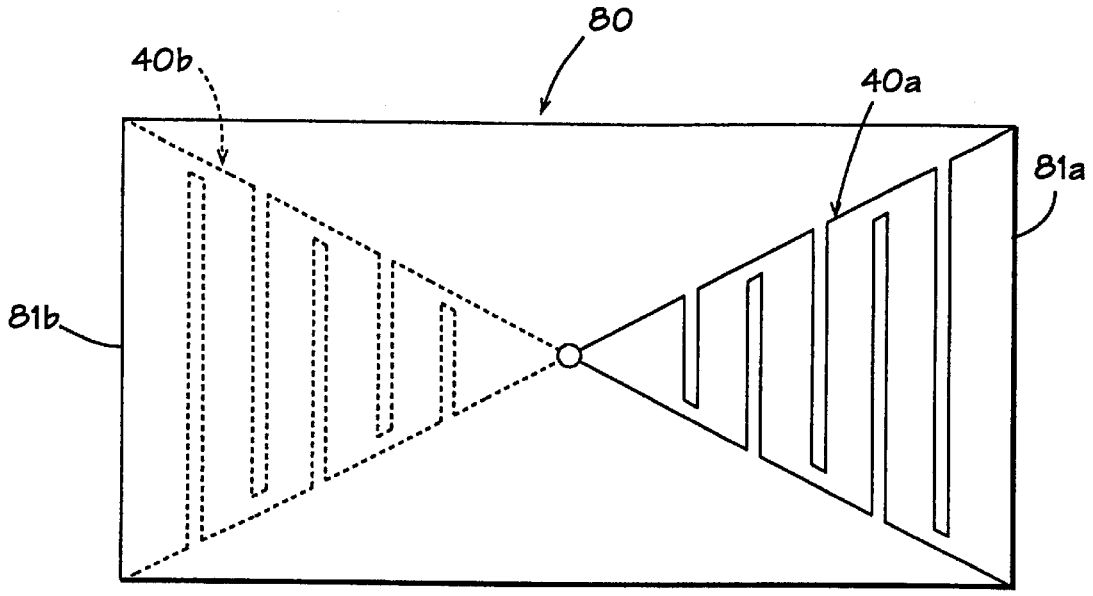

Referring now to FIG. 6C, the meandering electrically conductive patterns 44*a*, 44*b* of each respective radiating element 40*a*, 40*b* have dimensions and configurations different from those of the antenna embodiment of FIG. 3A. FIG. 6C illustrates the flexibility an antenna designer has in constructing a diversity or primary antenna to resonate within selected multiple frequency bands.

Figure 6D:
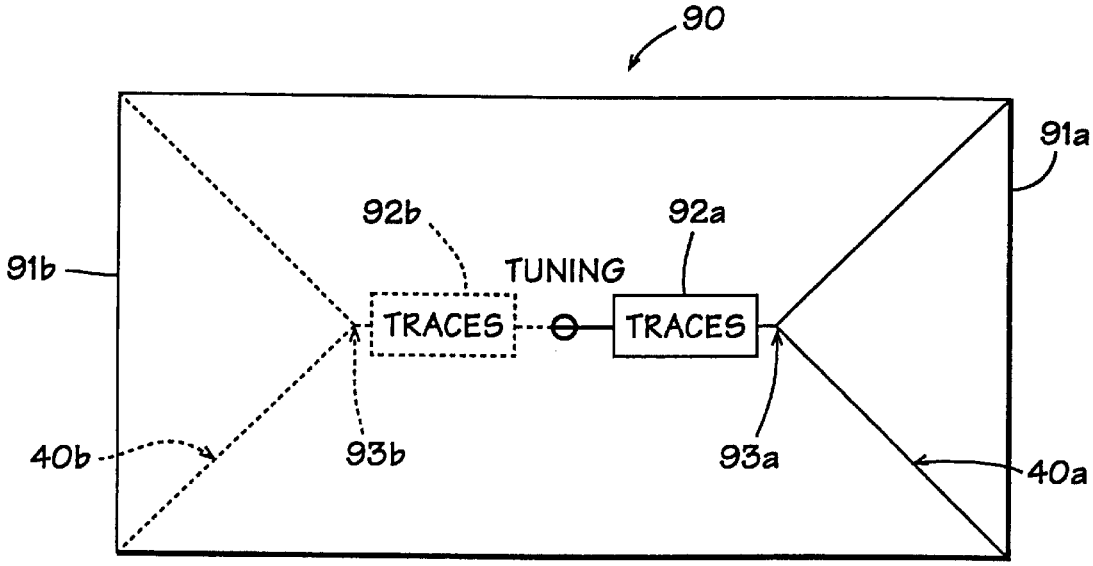

In FIG. 6D, the first and second radiating elements 40*a*, 40*b* of the illustrated antenna 90 have a generally triangular shape and are smaller in size than the radiating elements of FIGS. 3A–3D. The first and second radiating elements 40*a*, 40*b* taper from respective ends 91*a* and 91*b* to respective medial portions 93*a* and 93*b*, as illustrated. Electrical traces 92*a*, 92*b* are utilized to increase the electrical length of the first and second radiating elements 40*a* and 40*b*, respectively. As illustrated, the electrical traces 92*a*, 92*b* are positioned between the two medial portions 93*a*, 93*b* of the antenna 90.

Figure 6E:
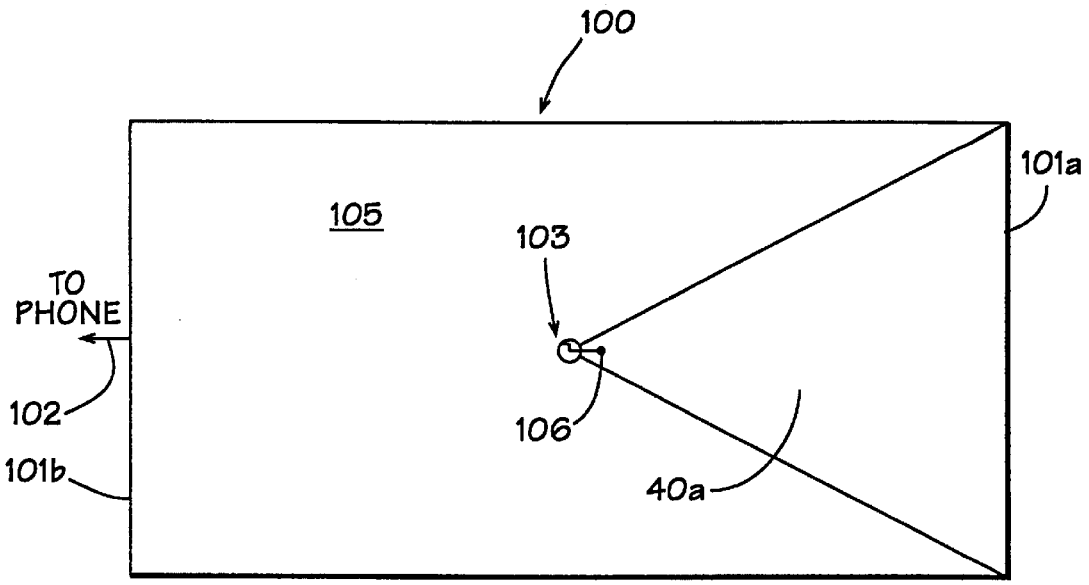

Referring now to FIG. 6E, an antenna 100 includes a single radiating element 40*a* tapering from an end 101*a* to a medial portion 103 of the face 105. An opposite end 101*b* of the illustrated antenna 100 is connected (indicated by 102) to ground via the chassis of a radiotelephone. A conductor of an antenna feed is electrically connected to the radiating element 40*a* (indicated by 106). Preferably, the illustrated antenna 100 forms a ¼ wave antenna.

It is to be understood that the present invention is not limited to the embodiments illustrated in FIGS. 3A–3D and 6A–6D. Various other configurations incorporating aspects of the present invention may be utilized, without limitation.

Figure 7:
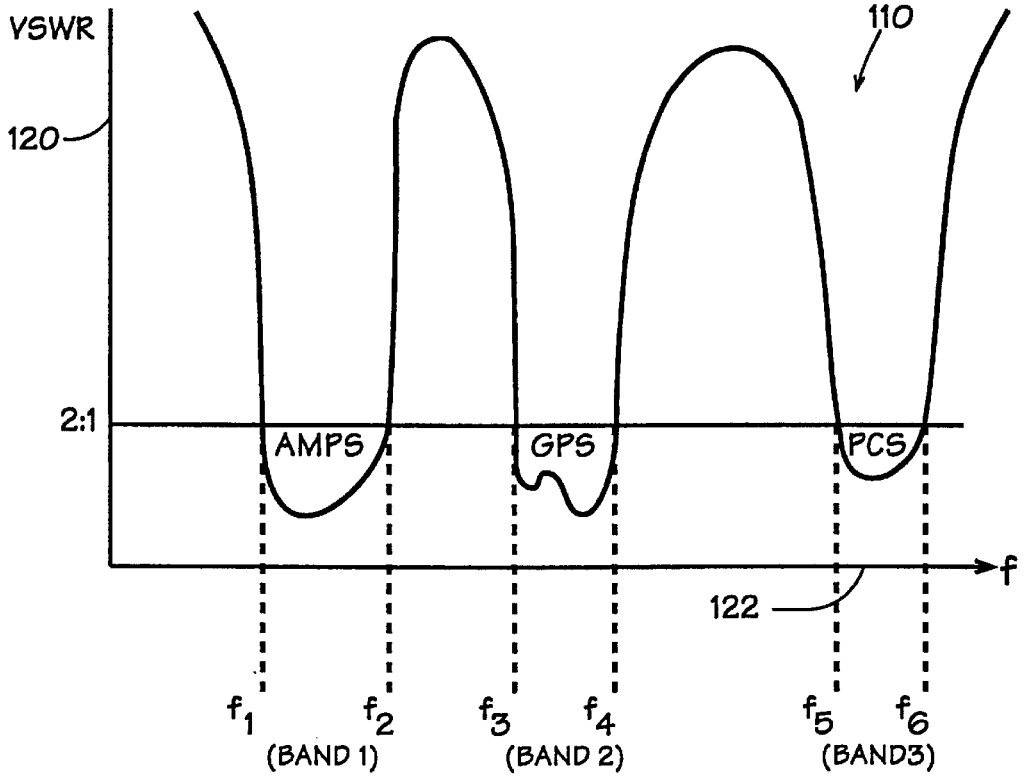
FIG. 7 illustrates an exemplary resonance curve achievable by the antenna of FIGS. 3A–3D.

Referring now to FIG. 7, an exemplary resonance curve 110 achievable by the antenna 30 of FIGS. 3A–3D is illustrated. VSWR is plotted along the "Y" axis and is indicated as 120. Frequency is plotted along the "X" axis and is indicated as 122. As shown by the illustrated resonance curve 110, the radiating elements 40*a*, 40*b* of the antenna 30 are configured to resonate in three frequency bands (Band 1), (Band 2), and (Band 3). By changing the configuration of the slots 42*a*, 42*b* in the respective radiating elements 40*a*, 40*b* of the antenna 30, the antenna 30 can be made to resonate in various bands.

As illustrated, Band 1 extends from frequency $f_1$ to frequency $f_2$, Band 2 extends from frequency $f_3$ to frequency $f_4$, and Band 3 extends from frequency $f_5$ to frequency $f_6$. For example, Band 1 may include AMPS frequencies; Band 2 may include GPS frequencies; and Band 3 may include PCS frequencies. Bands 1–3 are each below the 2:1 VSWR to facilitate impedance matching. The resonance curve 110 shows where (in frequency) a match between an antenna and the receiver circuit will result in 0.5 dB or less of loss. The represented triple-band antenna is made to approach a ½ wave antenna.

Antennas according to the present invention, when used as diversity antennas, are particularly well suited for combating both Rayleigh (line of sight and one main reflection) and Ricean (multiple reflections) fading. The present invention allows a diversity antenna to reside in a flip cover of a small mobile radiotelephone and helps when the primary antenna enters into a very large fade region or when it is desirable for the radiotelephone to function in other frequency bands. Antennas according to the present invention, when used as either diversity or primary antennas, are designed for operation within three frequency bands. Accordingly antennas according to the present invention are particularly well suited for operation within various communications systems utilizing multiple frequency bands.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An antenna, comprising:

a dielectric substrate comprising opposite first and second faces, and opposite first and second ends;

a first radiating element disposed on said dielectric substrate first face adjacent said first end, said first radiating element comprising a first meandering electrically conductive path, said first radiating element tapering from said first end to a medial portion of said first face; and a second radiating element disposed on said dielectric substrate second face adjacent said second end, said second radiating element comprising a second meandering electrically conductive path, said second radiating element tapering from said second end to a medial portion of said second face.

2. An antenna according to claim 1 wherein said first and second meandering electrically conductive paths have different electrical lengths.

3. An antenna according to claim 1 wherein said first and second radiating elements have different surface areas.

4. An antenna according to claim 1 further comprising an electrical trace that adds electrical length to said first radiating element.

5. An antenna according to claim 1 further comprising an electrical trace that adds electrical length to said second radiating element.

6. An antenna according to claim 1 further comprising an antenna feed including first and second conductors, said first conductor electrically connected to said first radiating element and said second conductor electrically connected to said second radiating element.

7. An antenna according to claim 6 further comprising an aperture formed through said dielectric substrate adjacent said first and second face medial portions, and wherein said antenna feed first conductor extends through said aperture.

8. An antenna according to claim 1 wherein said dielectric substrate has a dielectric constant between 4.4 and 4.8.

9. An antenna according to claim 1 wherein said first and second radiating elements jointly resonate within multiple frequency bands.

10. An antenna according to claim 1 wherein said first and second radiating elements jointly resonate within three frequency bands.

11. An antenna assembly for a communications device, said antenna assembly comprising:

a dielectric substrate comprising opposite first and second faces, and opposite first and second ends;

a first radiating element disposed on said dielectric substrate first face adjacent said first end, said first radiating element comprising a first meandering electrically conductive path, said first radiating element tapering from said first end to a medial portion of said first face;

a second radiating element disposed on said dielectric substrate second face adjacent said second end, said second radiating element comprising a second meandering electrically conductive path, said second radiating element tapering from said second end to a medial portion of said second face; and an antenna feed including first and second conductors, said first conductor electrically connected to said first radiating element, and said second conductor electrically connected to said second radiating element.

12. An antenna assembly according to claim 11 wherein said first and second meandering electrically conductive paths have different electrical lengths.

13. An antenna assembly according to claim 11 wherein said first and second radiating elements have different surface areas.

14. An antenna assembly according to claim 11 further comprising an electrical trace that adds electrical length to said first radiating element.

15. An antenna assembly according to claim 11 further comprising an electrical trace that adds electrical length to said second radiating element.

16. An antenna assembly according to claim 11 further comprising an aperture formed through said dielectric substrate adjacent said first and second face medial portions, and wherein said antenna feed first conductor extends through said aperture.

17. An antenna assembly according to claim 11 wherein said dielectric substrate has a dielectric constant between 4.4 and 4.8.

18. An antenna assembly according to claim 11 wherein said first and second radiating elements jointly resonate within multiple frequency bands.

19. An antenna assembly according to claim 11 wherein said first and second radiating elements jointly resonate within three frequency bands.

20. A radiotelephone apparatus, comprising:

a housing configured to enclose electronic components that transmit and receive radiotelephone communications signals;

a flip cover hinged to said housing; and an antenna assembly disposed within said flip cover, said antenna assembly comprising:

a dielectric substrate comprising opposite first and second faces, and opposite first and second ends;

a first radiating element disposed on said dielectric substrate first face adjacent said first end, said first radiating element comprising a first meandering electrically conductive path, said first radiating element tapering from said first end to a medial portion of said first face;

a second radiating element disposed on said dielectric substrate second face adjacent said second end, said second radiating element comprising a second meandering electrically conductive path, said second radiating element tapering from said second end to a medial portion of said second face; and an antenna feed including first and second conductors, said first conductor electrically connected to said first radiating element, and said second conductor electrically connected to said second radiating element.

21. A radiotelephone according to claim 20 wherein said first and second meandering electrically conductive paths have different electrical lengths.

22. A radiotelephone according to claim 20 wherein said first and second radiating elements have different surface areas.

23. A radiotelephone according to claim 20 further comprising an electrical trace that adds electrical length to said first radiating element.

24. A radiotelephone according to claim 20 further comprising an electrical trace that adds electrical length to said second radiating element.

25. A radiotelephone according to claim 20 further comprising an aperture formed through said dielectric substrate adjacent said first and second face medial portions, and wherein said antenna feed first conductor extends through said aperture.

26. A radiotelephone according to claim 20 wherein said dielectric substrate has a dielectric constant between 4.4 and 4.8.

27. A radiotelephone according to claim 20 wherein said first and second radiating elements jointly resonate within multiple frequency bands.

28. A radiotelephone according to claim 20 wherein said first and second radiating elements jointly resonate within three frequency bands.

29. A radiotelephone apparatus, comprising:

a housing configured to enclose electronic components that transmit and receive radiotelephone communications signals;

a flip cover hinged to said housing; and an antenna assembly disposed within said flip cover, said antenna assembly comprising:

a dielectric substrate; and a radiating element disposed on a face of said dielectric substrate adjacent an end thereof, said radiating element comprising a meandering electrically conductive path, said radiating element tapering from said end to a medial portion of said face.

30. A radiotelephone according to claim 29 further comprising an aperture formed through said dielectric substrate at said medial portion.

31. A radiotelephone according to claim 30 further comprising a conductor of an antenna feed extending through said aperture and electrically connected to said radiating element.

32. A radiotelephone according to claim 29 wherein said radiating element resonates within multiple frequency bands.

33. An electronic device, comprising:

a housing;

a flip cover hinged to said housing; and an antenna disposed within said flip cover, comprising:

a dielectric substrate comprising opposite first and second faces, and opposite first and second ends;

a first radiating element disposed on said dielectric substrate first face adjacent said first end, said first radiating element comprising a first meandering electrically conductive path, said first radiating element tapering from said first end to a medial portion of said first face; and a second radiating element disposed on said dielectric substrate second face adjacent said second end, said second radiating element comprising a second meandering electrically conductive path, said second radiating element tapering from said second end to a medial portion of said second face.

34. An electronic device according to claim 33 wherein said first and second meandering electrically conductive paths have different electrical lengths.

35. An electronic device according to claim 33 wherein said first and second radiating elements have different surface areas.

* * * * *